US009732716B2

(12) United States Patent
Serizawa et al.

(10) Patent No.: US 9,732,716 B2
(45) Date of Patent: Aug. 15, 2017

(54) FUEL INJECTION NOZZLE

(71) Applicant: DENSO CORPORATION, Kariya, Aichi-pref. (JP)

(72) Inventors: Kazufumi Serizawa, Kariya (JP); Shinya Sano, Kariya (JP); Atsushi Utsunomiya, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/001,559

(22) Filed: Jan. 20, 2016

(65) Prior Publication Data

US 2016/0215746 A1 Jul. 28, 2016

(30) Foreign Application Priority Data

Jan. 22, 2015 (JP) ..... 2015-010534

(51) Int. Cl.
*F02M 61/10* (2006.01)
*F02M 61/18* (2006.01)

(52) U.S. Cl.
CPC ..... *F02M 61/10* (2013.01); *F02M 61/184* (2013.01); *F02M 61/1833* (2013.01); *F02M 61/1846* (2013.01)

(58) Field of Classification Search
CPC .. F02M 61/10; F02M 61/1806; F02M 6/1833; F02M 61/184; F02M 61/184661
USPC ..... 239/533.12, 601
See application file for complete search history.

(56) References Cited

U.S. PATENT DOCUMENTS 6,978,948 B2 * 12/2005 Heinecke ..... F02M 61/1806 239/533.12
2004/0011890 A1 1/2004 Heinecke

FOREIGN PATENT DOCUMENTS

| | | |
|---|---|---|
| JP | 2010-180763 | 8/2010 |
| JP | 2010-222977 | 10/2010 |
| JP | 2014-025298 | 2/2014 |
| JP | 2014-208991 | 11/2014 |

* cited by examiner

*Primary Examiner* — Darren W Gorman
(74) *Attorney, Agent, or Firm* — Nixon & Vanderhye P.C.

(57) ABSTRACT

In an injection hole of a nozzle, a maximum value of a longitudinal length of an inlet, which is measured in a direction of an inlet longitudinal axis of the inlet, is larger than a maximum value of a longitudinal length of an outlet, which is measured in a direction of an outlet longitudinal axis of the outlet. A rear end edge of an opening edge of the inlet is shaped into an arc. When the maximum value of the inlet is made larger than the maximum value of the outlet, an upstream end of the inlet can be placed at a further upstream side, so that a turn angle of a fuel flow can be reduced to increase the flow coefficient. Furthermore, when the rear end edge is shaped into the arc, the maximum value of the inlet can be increased.

5 Claims, 18 Drawing Sheets

FUEL INJECTION NOZZLE

CROSS REFERENCE TO RELATED APPLICATION

This application is based on and incorporates herein by reference Japanese Patent Application No. 2015-10534 filed on Jan. 22, 2015.

TECHNICAL FIELD

The present disclosure relates to a fuel injection nozzle (hereinafter also simply referred to as a nozzle), which injects fuel.

BACKGROUND

A known fuel injection valve, which injects fuel to supply the fuel in an internal combustion engine, includes a nozzle for injecting the fuel and an actuator for driving the nozzle in a valve opening direction and a valve closing direction. The nozzle of the fuel injection valve includes a nozzle body, which is shaped into a cylindrical tubular form, and a needle, which is received in an inside of the nozzle body in such a manner that the needle is movable in an axial direction of the nozzle body. Injection of fuel from the nozzle body is started or stopped by moving the needle in the axial direction in the inside of the nozzle body.

Specifically, a seat portion is formed in an inner wall of the nozzle body, and a seatable portion of the needle, which is formed at a location adjacent to a tip end of the needle in the axial direction, is seatable against the seat portion. Furthermore, a plurality of injection holes extends through a portion of the inner wall, which is located on the tip end side of the seat portion. When the seatable portion of the needle is lifted from the seat portion, the fuel is guided from the inside of the nozzle body to the outside of the nozzle body and is injected (see, for example, JP2010-180763A).

Various studies have been conducted to increase a flow coefficient, which indicates a degree of flowability of the fuel, in order to implement an advantageous structure, which is advantageous in terms of the energy, in the fuel injection nozzle.

For example, in the nozzle of JP2010-222977A, an opening of the injection hole at the inside of the nozzle body is shaped into a semi-ellipse form, so that generation of cavitation in the injection hole or localization of the flow of the fuel can be limited, and thereby the flow coefficient can be improved.

Furthermore, in the nozzle of JP2014-208991A, a longitudinal length of an inlet of the injection hole, which is measured in a direction perpendicular to a circumferential direction of the nozzle body, is set to be larger than a longitudinal length of an outlet of the injection hole, which is measured in the direction perpendicular to the circumferential direction of the nozzle body. In this way, an upstream end of the inlet can be placed at a further upstream side, so that a turn angle of the fuel flow can be reduced to increase the flow coefficient.

However, the flow coefficient of the fuel injection nozzle is reduced when the injection pressure of the fuel is increased. Thus, the increase of the injection pressure is disadvantageous in terms of the energy. Therefore, it has been demanded to improve the flow coefficient in applications where the high injection pressure of the fuel is demanded like in a case of a fuel injection valve that directly injects the fuel into a cylinder of, for example, a diesel engine.

SUMMARY

The present disclosure is made in view of the above disadvantage. Thus, it is an objective of the present disclosure to provide a fuel injection nozzle, which injects fuel into an internal combustion engine and can achieve an improved flow coefficient.

According to the present disclosure, there is provided a fuel injection nozzle that includes a nozzle body and a needle. The nozzle body is shaped into a tubular form. The needle is received in an inside of the nozzle body in such a manner that the needle is movable in an axial direction of the nozzle body. The fuel injection nozzle starts or stops injection of fuel by lifting or seating the needle relative to a seat portion, which is formed in an inner peripheral portion of the nozzle body. The nozzle body includes an injection hole that opens in both of an inner wall and an outer wall of the nozzle body on a tip end side of the seat portion in the axial direction. The tip end side is a side where a tip end of the nozzle body is placed, while a rear end side is a side where a rear end of the nozzle body is placed. In a state where the needle is seated against the seat portion, when the needle is moved from the seat portion toward the rear end side in the axial direction, the needle is lifted from the seat portion, and thereby the fuel is guided from the inside of the nozzle body to an outside of the nozzle body through the injection hole. With respect to an inlet, which is an opening of the injection hole in the inner wall, an inlet transverse axis is defined to extend in a circumferential direction of the nozzle body in parallel with a plane of the inlet, and an inlet longitudinal axis is defined to extend in a direction perpendicular to the inlet transverse axis in parallel with the plane of the inlet. With respect to an outlet, which is an opening of the injection hole in the outer wall, an outlet transverse axis is defined to extend in the circumferential direction in parallel with a plane of the outlet, and an outlet longitudinal axis is defined to extend in a direction perpendicular to the outlet transverse axis in parallel with the plane of the outlet. A maximum value of a longitudinal length of the inlet measured in a direction of the inlet longitudinal axis is larger than a maximum value of a longitudinal length of the outlet measured in a direction of the outlet longitudinal axis. A maximum value of a transverse length of the inlet measured in the direction of the inlet transverse axis is defined between two maximum transverse length forming points of an opening edge of the inlet, and a portion of the opening edge of the inlet, which is located on the rear end side of the two maximum transverse length forming points, is shaped into an arc

BRIEF DESCRIPTION OF THE DRAWINGS

The drawings described herein are for illustration purposes only and are not intended to limit the scope of the present disclosure in any way.

DETAILED DESCRIPTION

A fuel injection nozzle of various embodiments will be described. The following embodiments are mere examples of the present disclosure, and the present disclosure is not limited to the following embodiments.

First Embodiment

A fuel injection nozzle 1 (hereinafter referred to as a nozzle 1) according to a first embodiment of the present disclosure will be described with reference to FIGS. 1 to 5B.

The nozzle 1 is provided to inject fuel at the time of valve opening and forms a fuel injection valve in cooperation with an actuator (not shown), which executes a valve opening operation or a valve closing operation of the nozzle 1. The fuel injection valve is installed to, for example, an internal combustion engine (not shown) and is used to directly inject the fuel of a high pressure, which is more than 100 MPa, into a cylinder of the internal combustion engine.

The actuator drives a valve element (a needle 2 described later) of the nozzle 1 by increasing or decreasing a back pressure applied to the valve element. The actuator uses a magnetic force, which is generated through energization of a coil (not shown), to open or close a back pressure chamber (not shown) and thereby to increase or decrease the back pressure.

The fuel injection valve cooperates with a fuel supply pump (not shown), which pressurizes the fuel and discharges the pressurized fuel, and an accumulator vessel (not shown), which is also known as a common rail and accumulates the fuel in a high pressure state discharged from the fuel supply pump, to form a fuel supply apparatus of a pressure accumulation type. The high pressure fuel is distributed from the accumulator vessel to the fuel injection valves and is injected from the fuel injection valves into the cylinders of the internal combustion engine.

Figure 1:
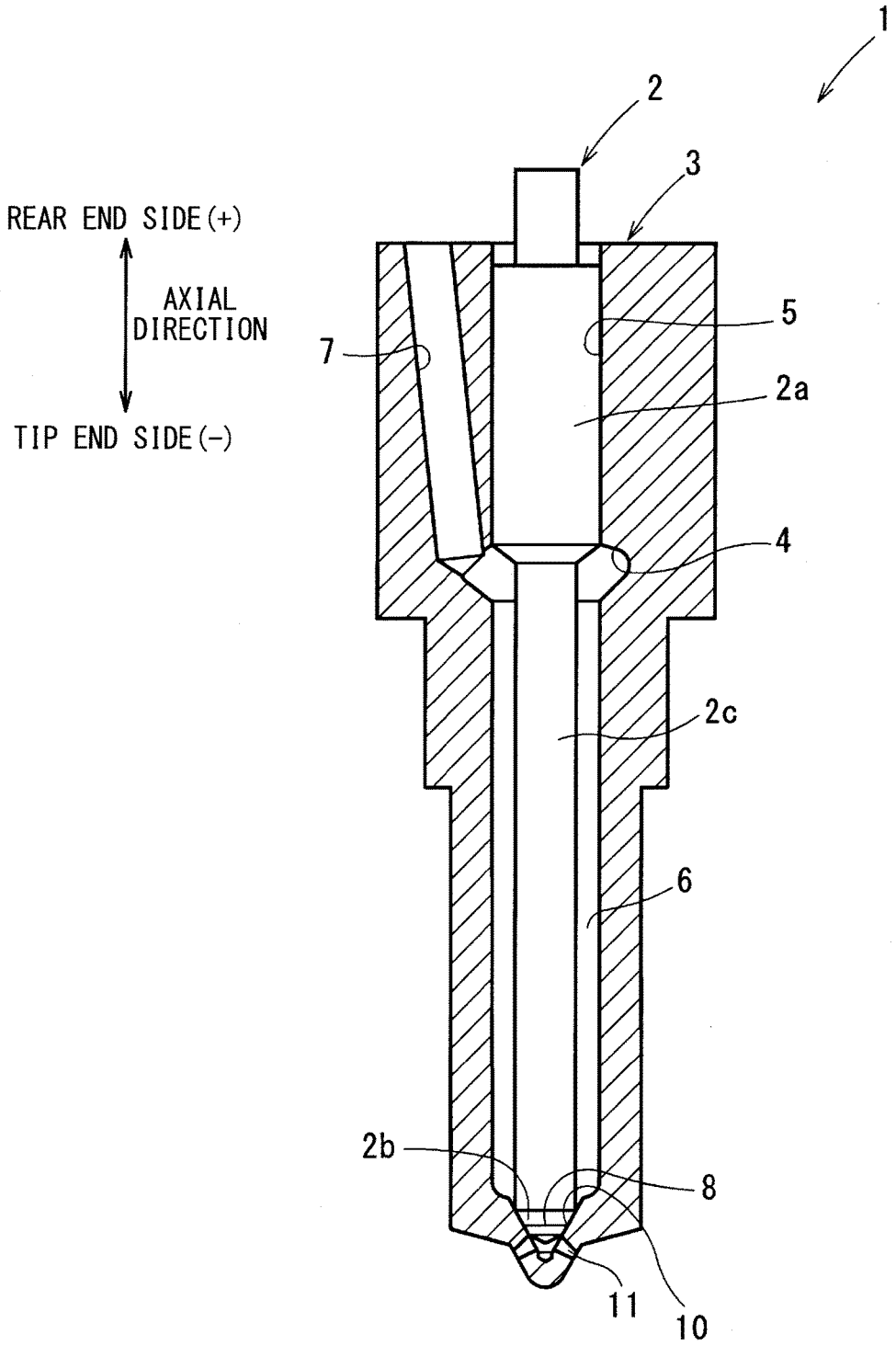
FIG. 1 is a cross-sectional view schematically showing a fuel injection nozzle according to a first embodiment of the present disclosure.

As shown in FIG. 1, the nozzle 1 includes a nozzle body 3 and a needle 2. The nozzle body 3 is shaped into a cylindrical tubular form. The needle 2 is received in an inside of the nozzle body 3 in such a manner that the needle 2 is movable in an axial direction of the nozzle body 3. The injection of the fuel is started or stopped through movement of the needle 2 in the axial direction in the inside of the nozzle body 3.

The needle 2 includes a slidable shaft portion 2*a*, which is supported by the nozzle body 3 in an axially slidable manner, and a tip end portion 2*b*, which is shaped into a conical form and substantially functions as a valve portion. Furthermore, a cylindrical portion 2*c*, which is elongated in the axial direction, is formed between the slidable shaft portion 2*a* and the tip end portion 2*b*.

An inner peripheral portion of the nozzle body 3 is shaped into a cylindrical tubular form that is elongated in the axial direction. A tip end part of the inner peripheral portion of the nozzle body 3 has a progressively decreasing diameter and is thereby shaped into a conical form. Furthermore, a part of the inner peripheral portion of the nozzle body 3 has a locally elongated diameter to form a fuel well 4, in which the fuel to be injected is temporarily accumulated. With respect to the nozzle body 3, a tip end side is hereinafter defined as a side (the lower side in FIG. 1) where a tip end of the nozzle body 3 is placed, and a rear end side is hereinafter defined as a side (the upper side in FIG. 1) where a rear end of the nozzle body 3 is placed.

A rear end side region of the inner peripheral portion of the nozzle body 3, which is axially located on the rear end side of the fuel well 4, forms a slide hole 5, in which the slidable shaft portion 2*a* is slidably supported. Furthermore, a tip end side region of the inner peripheral portion of the nozzle body 3, which is axially located on the tip end side of the fuel well 4, receives the tip end portion 2*b* and the cylindrical portion 2*c* and forms a fuel passage 6, which is shaped into an annular form. In the nozzle body 3, a fuel passage 7, which guides the fuel received from the accumulator vessel to the fuel well 4, is connected to the fuel well 4.

Furthermore, a seat portion 10, relative to which a seatable portion 8 formed in the tip end portion 2*b* is liftable and seatable, is formed in a conical region having the progressively decreasing diameter toward the tip end side in the inner wall of the nozzle body 3. Furthermore, a plurality of injection holes 11 opens in a conical inner wall, which is axially located on the tip end side of the seat portion 10, in the inner wall of the nozzle body 3. When the seatable portion 8 is lifted from the seat portion 10, the fuel is guided from the inside of the nozzle body 3 to an outside of the nozzle body 3 through the injection holes 11 and is injected to the outside. In contrast, when the seatable portion 8 is seated against the seat portion 10, the injection of the fuel through the injection holes 11 is stopped.

Hereinafter, a characteristic structure of the nozzle 1 will be described with reference to FIGS. 2 to 5B.

First of all, for the purpose of describing the characteristic structure of the nozzle 1, axes will be defined with respect to an inlet 11*a*, which is an opening of the injection hole 11 in the inner wall of the nozzle body 3, and an outlet 11*b*, which is an opening of the injection hole 11 in the outer wall of the nozzle body 3.

Figure 3:
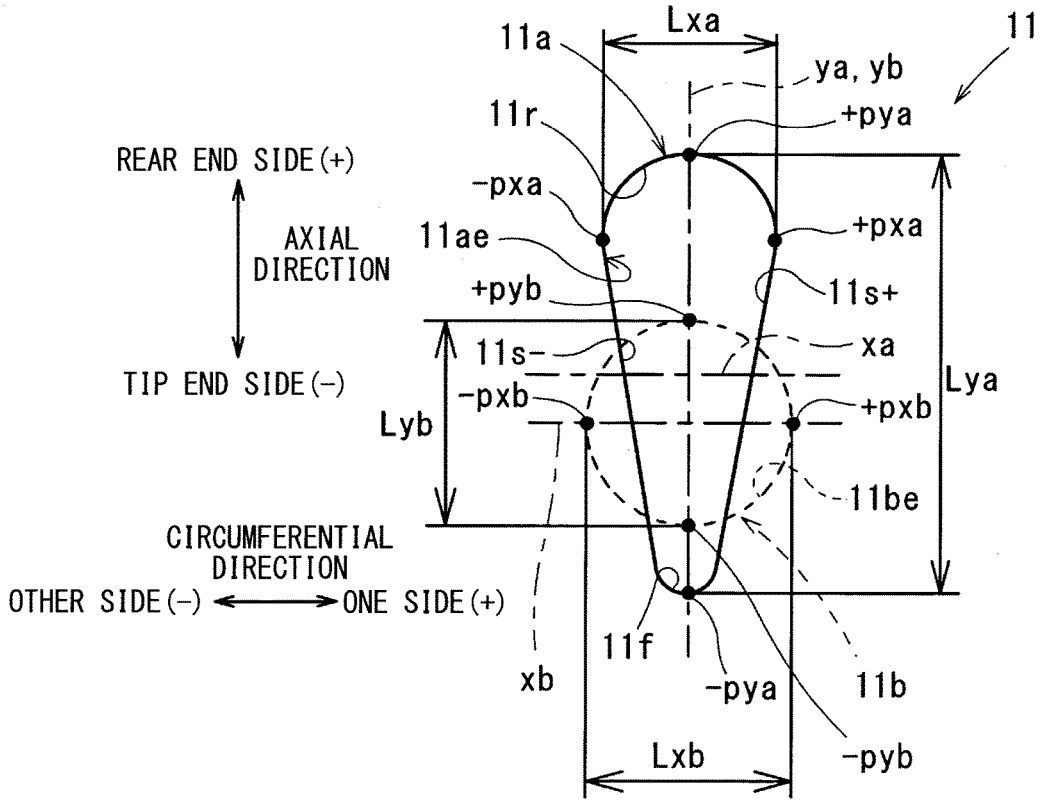
FIG. 3 is a descriptive view showing an inlet and an outlet of the injection hole according to the first embodiment.
Figure 4:
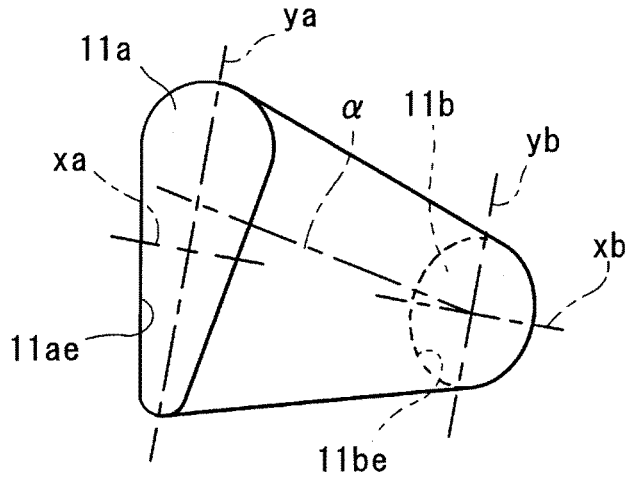
FIG. 4 is a schematic perspective view of the injection hole according to the first embodiment.

With respect to the inlet 11*a*, an inlet transverse axis xa is defined to extend in a circumferential direction of the nozzle body 3 in parallel with a plane of the inlet 11*a* (the plane of the inlet 11*a* being parallel to a plane of FIG. 3). Furthermore, an inlet longitudinal axis ya is defined to extend in a direction perpendicular to the inlet transverse axis xa in parallel with the plane of the inlet 11*a*. With respect to the outlet 11*b*, an outlet transverse axis xb is defined to extend in the circumferential direction in parallel with a plane of the outlet 11*b* (the plane of the outlet 11*b* being parallel to the plane of FIG. 3), and an outlet longitudinal axis yb is defined to extend in a direction perpendicular to the outlet transverse axis xb in parallel with the plane of the outlet 11*b*.

Next, when a maximum value Lxa of a transverse length of the inlet 11*a*, which is measured in a direction of the inlet transverse axis xa, and a maximum value Lya of a longitudinal length of the inlet 11*a*, which is measured in a direction of the inlet longitudinal axis ya, are taken into account, it is assumed that the inlet transverse axis xa is placed at a point (half longitudinal length point), at which ½ of the maximum value Lya of the longitudinal length of the inlet 11*a* is measured along the inlet longitudinal axis ya in the plane of the inlet 11*a*, and the inlet longitudinal axis ya is placed at a point (half transverse length point), at which ½ of the maximum value Lxa of the transverse length of the inlet 11*a* is measured along the inlet transverse axis xa in the plane of the inlet 11*a*. Furthermore, two points of an opening edge 11*ae* of the inlet 11*a*, between which the maximum value Lxa is formed, are defined as maximum transverse length forming points +pxa, −pxa. Also, other two points of the opening edge 11*ae* of the inlet 11*a*, between which the maximum value Lya is formed, are defined as maximum longitudinal length forming points +pya, −pya.

Furthermore, when a maximum value Lxb of a transverse length of the outlet 11*b*, which is measured in a direction of the outlet transverse axis xb, and a maximum value Lyb of a longitudinal length of the outlet 11*b*, which is measured in a direction of the outlet longitudinal axis yb, are taken into account, it is assumed that the outlet transverse axis xb is placed at a point (half longitudinal length point), at which ½ of the maximum value Lyb of the longitudinal length of the outlet 11*b* is measured along the outlet longitudinal axis yb in the plane of the outlet 11*b*, and the outlet longitudinal axis yb is placed at a point (half transverse length point), at which ½ of the maximum value Lxb of the transverse length of the outlet 11*b* is measured along the outlet transverse axis xb in the plane of the outlet 11*b*. Furthermore, two points of an opening edge 11*be* of the outlet 11*b*, between which the maximum value Lxb is formed, are defined as maximum transverse length forming points +pxb, −pxb. Also, other two points of the opening edge 11*be* of the outlet 11*b*, between which the maximum value Lyb is formed, are defined as maximum longitudinal length forming points +pyb, −pyb.

The maximum transverse length forming points +pxa, −pxa are located at one outermost side and the other outermost side, respectively, in the circumferential direction of the nozzle body 3 in the inlet 11*a*, so that the maximum transverse length forming points +pxa, −pxa form one circumferential end and the other circumferential end, respectively, of the opening edge 11*ae*. The maximum longitudinal length forming points +pya, −pya are located at an outermost rear end side and an outermost tip end side, respectively, in the axial direction of the nozzle body 3 in the inlet 11*a*, so that the maximum longitudinal length forming points +pya, −pya form an axial rear end and an axial tip end, respectively, of the opening edge 11*ae*.

The above discussion is also true for the maximum transverse length forming points +pxb, −pxb and the maximum longitudinal length forming points +pxb, −pxb of the outlet 11*b*. Therefore, the maximum transverse length forming points +pyb, −pyb form one circumferential end and the other circumferential end, respectively, of the opening edge 11*be*. Also, the maximum longitudinal length forming points +pyb, −pyb form an axial rear end and an axial tip end, respectively, of the opening edge 11*be*.

Now, the characteristic structure of the nozzle 1 will be more specifically described.

In the nozzle 1, the maximum value Lya is larger than the maximum value Lyb. In this instance, a shape of the opening edge 11*be* is a circle, and the maximum values Lxa, Lyb correspond to a diameter of the opening edge 11*be*. Furthermore, a shape of a cross section (longitudinal cross section) of the injection hole 11, which includes a hole axis α of the injection hole 11, is a trapezoid having two sides (edges) 11*m*, 11*n* that are parallel to each other and are included in the inlet 11*a* and the outlet 11*b*, respectively (see FIG. 2).

A portion (hereinafter referred to as a rear end edge 11*r*) of the opening edge 11*ae* of the inlet 11*a*, which is located on the rear end side of the maximum transverse length forming points +pxa, −pxa, is shaped into an arc. More specifically, the shape of the rear end edge 11*r* is a semicircular arc (half-circle), which has a central angle of 180 degrees and is symmetrical about the inlet longitudinal axis ya (serving as the axis of symmetry) along the circumferential direction. A straight line segment, which connects between the maximum transverse length forming points +pxa, −pxa, should become parallel to the inlet transverse axis xa and should have a length that is equal to the maximum value Lxa. Furthermore, the maximum longitudinal length forming point +pya is located on the inlet longitudinal axis ya. The maximum longitudinal length forming points +pxa, −pxa are located on the rear end side of the inlet transverse axis xa.

A tip end side portion of the opening edge 11*ae* of the inlet 11*a* (i.e., a remaining portion of the opening edge 11*ae*, which is other than the rear end edge 11*r*), which is located on the tip end side of the maximum transverse length forming points +pxa, −pxa, has the progressively decreasing transverse length, which is measured in the direction of the inlet transverse axis xa and is progressively decreased from the maximum transverse length forming points +pxa, −pxa toward a tip end (i.e., the maximum longitudinal length forming point −pya) of the opening edge 11*ae* of the inlet 11*a*.

More specifically, the remaining portion of the opening edge 11*ae* of the inlet 11*a*, which is other than the rear end edge 11*r*, includes a tip end edge 11*f* and two lateral edges 11*s*+, 11*s*−. The tip end edge 11*f* includes the maximum longitudinal length forming point −pya. Each of the lateral edges 11*s*+, 11*s*− smoothly connects between the tip end edge 11*f* and the rear end edge 11*r*. The lateral edges 11*s*+, 11*s*− are respectively located on one side (hereinafter referred to as one circumferential side) in the circumferential direction of the of the nozzle body 3 and the other side (hereinafter referred to as the other circumferential side) in the circumferential direction of the of the nozzle body 3. The term "smooth" refers to presence of continuous derivatives in a corresponding domain of the opening edge 11*ae*, 11*be* or a corresponding domain of the cross section of the injection hole 11 taken along the hole axis α (the cross section of the injection hole 11, which includes the hole axis α).

Furthermore, the lateral edges 11*s*+, 11*s*− are two straight line segments, respectively, which are symmetrical about the inlet longitudinal axis ya (serving as the axis of symmetry) along the circumferential direction. The shape of the tip end edge 11*f* is an arc that has a central angle of equal to or less than 180 degrees, and the tip end edge 11*f* is symmetrical about the inlet longitudinal axis ya in the circumferential direction.

Thereby, the opening edge 11*ae* is symmetrical about the inlet longitudinal axis ya (serving as the axis of symmetry) in the circumferential direction.

Furthermore, the maximum value Lxb is larger than the maximum value Lxa. That is, a diameter of the semicircular arc, which forms the rear end edge 11*r*, is smaller than a diameter of the opening edge 11*be*.

Now, advantages of the first embodiment will be described.

In the injection hole 11 of the nozzle 1 of the first embodiment, the maximum value Lya of the longitudinal length of the inlet 11*a* measured in the direction of the inlet longitudinal axis ya of the inlet 11*a* is larger than the maximum value Lyb of the longitudinal length of the outlet 11*b* measured in the direction of the outlet longitudinal axis yb. Furthermore, the portion (the rear end edge 11*r*) of the opening edge 11*ae* of the inlet 11*a*, which is located on the rear end side of the maximum transverse length forming points +pxa, −pxa, forms the arc, while the maximum value Lxa of the transverse length of the inlet 11*a* measured in the direction of the inlet transverse axis xa is formed between the maximum transverse length forming points +pxa, −pxa.

Thereby, a flow coefficient can be increased at the nozzle 1.

Figure 2:
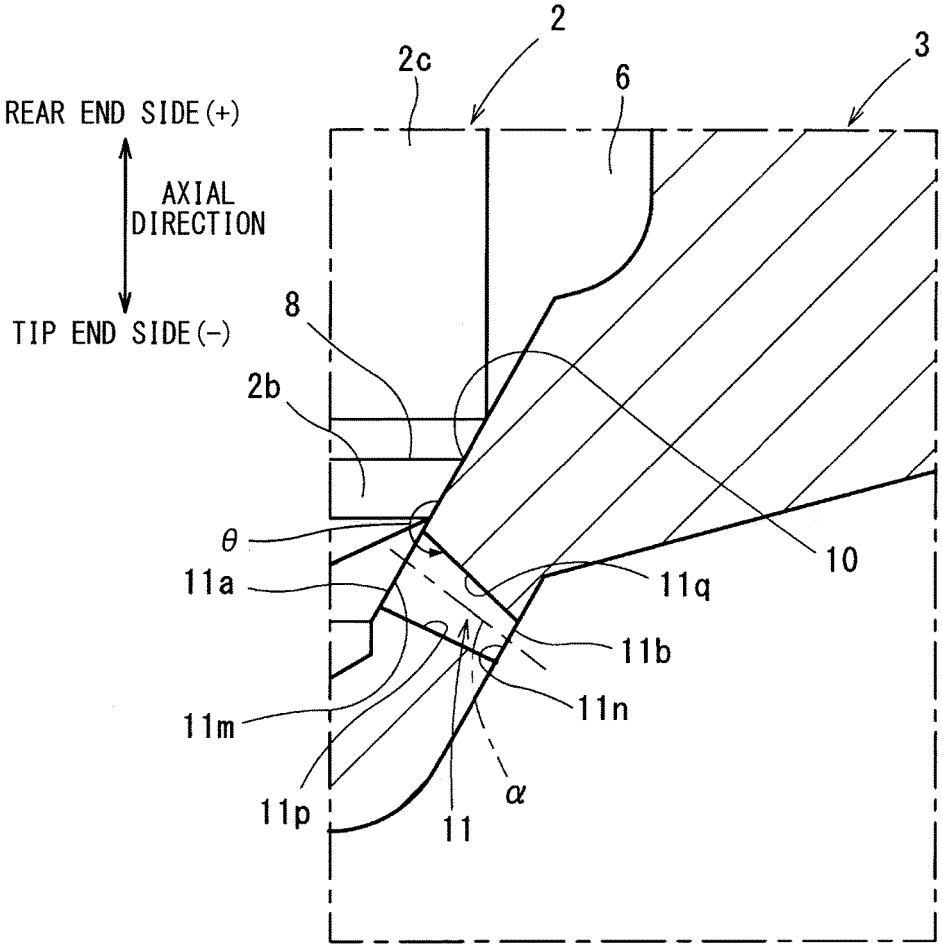
FIG. 2 is a partial enlarged cross-sectional view showing an injection hole of a nozzle body of the fuel injection nozzle of FIG. 1.

First of all, when the maximum value Lya is made larger than the maximum value Lyb, an upstream end (the maximum longitudinal length forming point +pya) of the inlet 11*a* can be placed at a further upstream side, so that a turn angle (also referred to as a swirling angle) θ of the fuel flow (see FIG. 2) can be reduced to increase the flow coefficient. In the case of the injection hole 11 shown in FIG. 2, the turn angle θ of the fuel flow is a turn angle of the fuel flow, which is turned into the injection hole 11 in the plane of FIG. 2 after flowing along the seat portion 10 at the time of lifting the seatable portion 8 of the needle 2 from the seat portion 10. In FIG. 2, the turn angle θ is indicated as an angle defined between the inner wall of the seat portion 10 and the inner wall of the injection hole 11. Furthermore, with respect to the shape of the opening edge 11*ae*, when the rear end edge 11*r* is shaped into the arc, the maximum value Lya can be further increased while the cross sectional area of the inlet 11*a* is kept to be the same in comparison to the case where a straight line segment is included in the rear end edge 11*r*. Therefore, the maximum longitudinal length forming point +pya can be placed at the further upstream side (the further rear end side), so that the turn angle θ (see FIG. 2) can be further reduced to increase the flow coefficient.

Figure 5A:
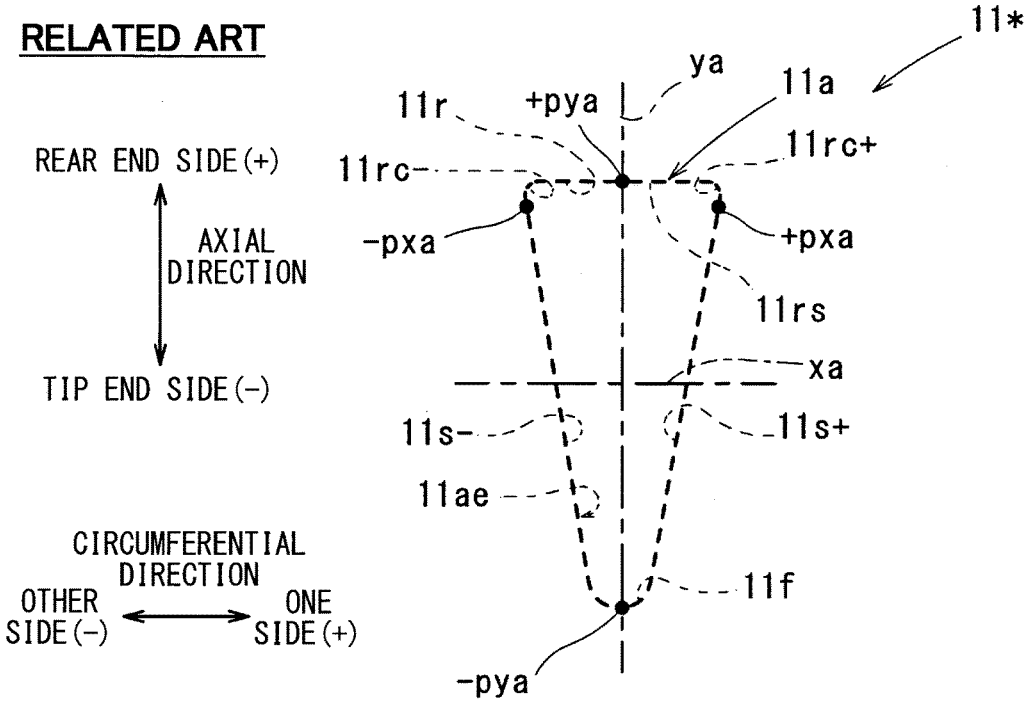
FIG. 5A RELATED ART
FIG. 5A is a descriptive view showing a shape of an inlet of an injection hole of a comparative example.

FIG. 5A indicates an injection hole 11* of a comparative example that has a straight line segment 11*rs* in the rear end edge 11*r* while the cross sectional area of the inlet 11*a* of the injection hole 11* is the same as the cross sectional area of the inlet 11 of the first embodiment.

Here, similar to the injection hole 11 of the first embodiment, the injection hole 11* of the comparative example is symmetrical about the inlet longitudinal axis ya (serving as the axis of symmetry) along the circumferential direction. The rear end edge 11*r* includes the straight line segment 11*rs*, and two arc segments 11*rc*+, 11*rc*−. The arc segments 11*rc*+, 11*rc*− are smoothly connected to two ends, respectively, of the straight line segment 11*rs*. Furthermore, the lateral edges 11*s*+, 11*s*− of the injection hole 11* are further extended toward the rear end side in comparison to the lateral edges 11*s*+, 11*s*− of the injection hole 11. The shape of the tip end edge 11*f* of the injection hole 11* is the same as the shape of the tip end edge 11*f* of the injection hole 11.

Figure 5B:
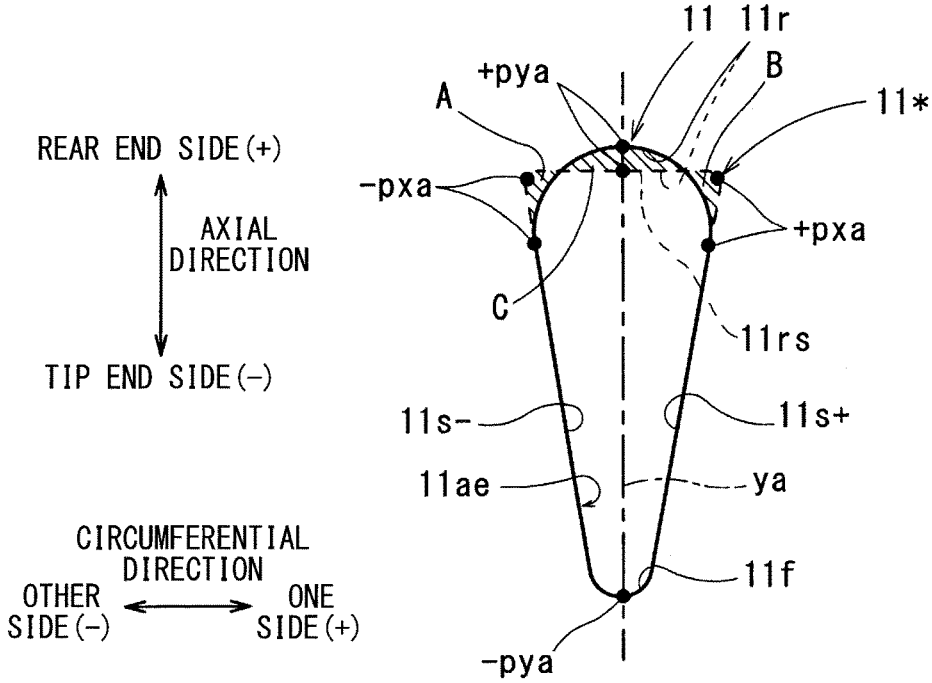
FIG. 5B is a descriptive view showing a shape of the inlet of the injection hole of the first embodiment superimposed on the inlet of the injection hole of the comparative example shown in FIG. 5A.

As shown in FIG. 5B, when the injection hole 11 is superimposed on the injection hole 11* in such a manner that the tip end edge 11*f* and the lateral edges 11*s*+, 11*s*− of the injection hole 11 coincide with the tip end edge 11*f* and the lateral edges 11*s*+, 11*s*− of the injection hole 11*, a total surface area of a region A and a region B becomes equal to a surface area of a region C, and the maximum longitudinal length forming point +pya of the injection hole 11 is located on the rear end side of the maximum longitudinal length forming point +pya of the injection hole 11*.

That is, when the entire rear end edge 11*r* is shaped into the arc, the upstream end (the maximum longitudinal length forming point +pya) of the inlet 11*a* can be placed at the further upstream side while the cross-sectional area of the inlet 11*a* is kept as the same as that of the injection hole 11*.

Furthermore, the tip end side portion of the opening edge 11*ae* of the inlet 11*a*, which is located on the tip end side of the maximum transverse length forming points +pxa, −pxa, has the progressively decreasing transverse length, which is measured in the direction of the inlet transverse axis xa and is progressively decreased from the maximum transverse length forming points +pxa, −pxa toward the tip end (the maximum longitudinal length forming point −pya) of the opening edge 11*ae* of the inlet 11*a*.

The inlet 11*a* is located in the inner wall, which is shaped into the conical form. Therefore, in order to maintain an appropriate circumferential distance between circumferentially adjacent two of the injection holes 11 in terms of the structural strength of the tip end portion of the nozzle body 3, it is desirable that the transverse length of the injection hole 11 measured in the direction of the inlet transverse axis xa is progressively reduced toward the tip end side of the injection hole 11. That is, the circumferential distance between the circumferentially adjacent two of the injection holes 11 can be appropriately kept in terms of the structural strength of the tip end portion of the nozzle body 3 by forming each injection hole 11 such that the tip end side portion of the opening edge 11*ae* of the inlet 11*a*, which is located on the tip end side of the maximum transverse length forming points +pxa, −pxa, has the progressively decreasing transverse length, which is measured in the direction of the inlet transverse axis xa and is progressively decreased toward the tip end side.

Furthermore, the maximum transverse length forming points +pxa, −pxa are located on the rear end side of the point (half longitudinal length point), at which ½ of the maximum value Lya is measured along the inlet longitudinal axis ya, in the opening edge 11*ae*.

In this way, the circumferential distance between the circumferentially adjacent two of the injection holes 11 can be further appropriately kept in terms of the structural strength of the tip end portion of the nozzle body 3.

Also, the maximum value Lxb of the transverse length of the outlet 11*b*, which is measured in the direction of the outlet transverse axis xb, is larger than the maximum value Lxa of the transverse length of the inlet 11*a*, which is measured in the direction of the inlet transverse axis xa.

In this way, it is possible to limit a decrease in the flow quantity of the fuel, which is caused by the setting of the maximum value Lya to be larger than the maximum value Lyb.

Second Embodiment

A characteristic structure of a nozzle 1 according to a second embodiment of the present disclosure will be described mainly with respect to differences, which differ from the nozzle 1 of the first embodiment.

Figure 6:
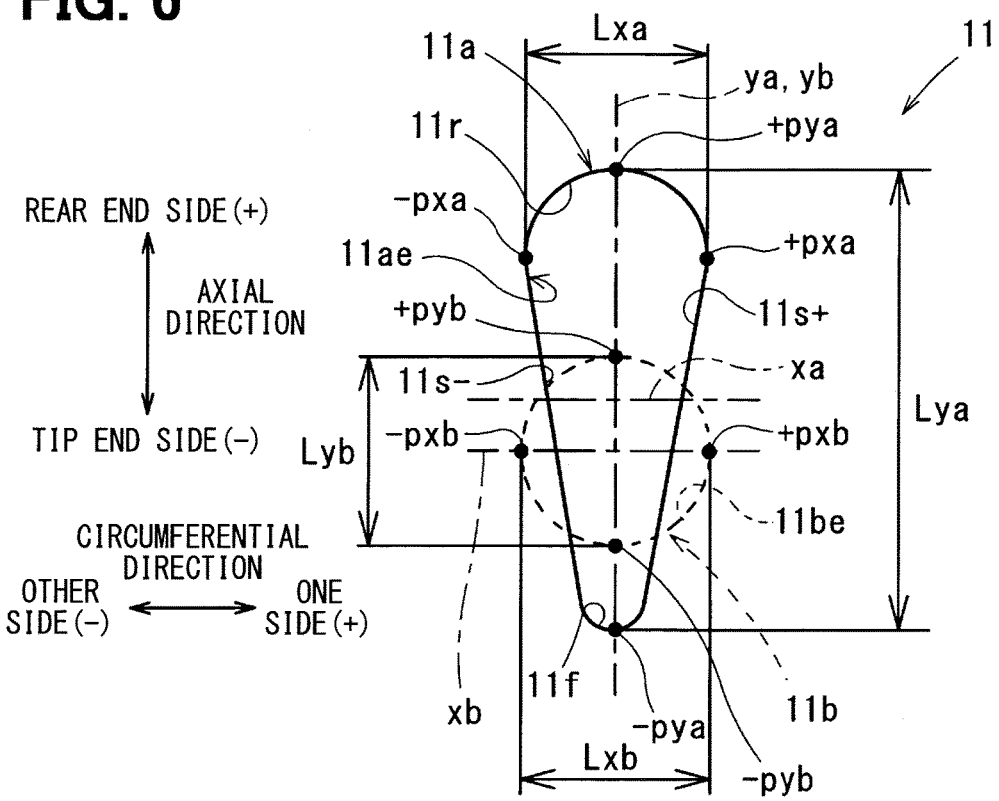
FIG. 6 is a descriptive view showing an inlet and an outlet of an injection hole according to a second embodiment of the present disclosure.

In the nozzle 1 of the second embodiment, as shown in FIG. 6, the shape of the opening edge 11*be* of the outlet 11*b* is a circle, and the diameter (maximum values Lxb, Lyb) of the opening edge 11*be* is equal to the maximum value Lxa of the inlet 11*a*. The shape of the opening edge 11*ae* of the inlet 11*a* is the same as that of the nozzle 1 of the first embodiment.

Third Embodiment

A characteristic structure of a nozzle 1 according to a third embodiment of the present disclosure will be described mainly with respect to differences, which differ from the nozzle 1 of the first embodiment.

Figure 7:
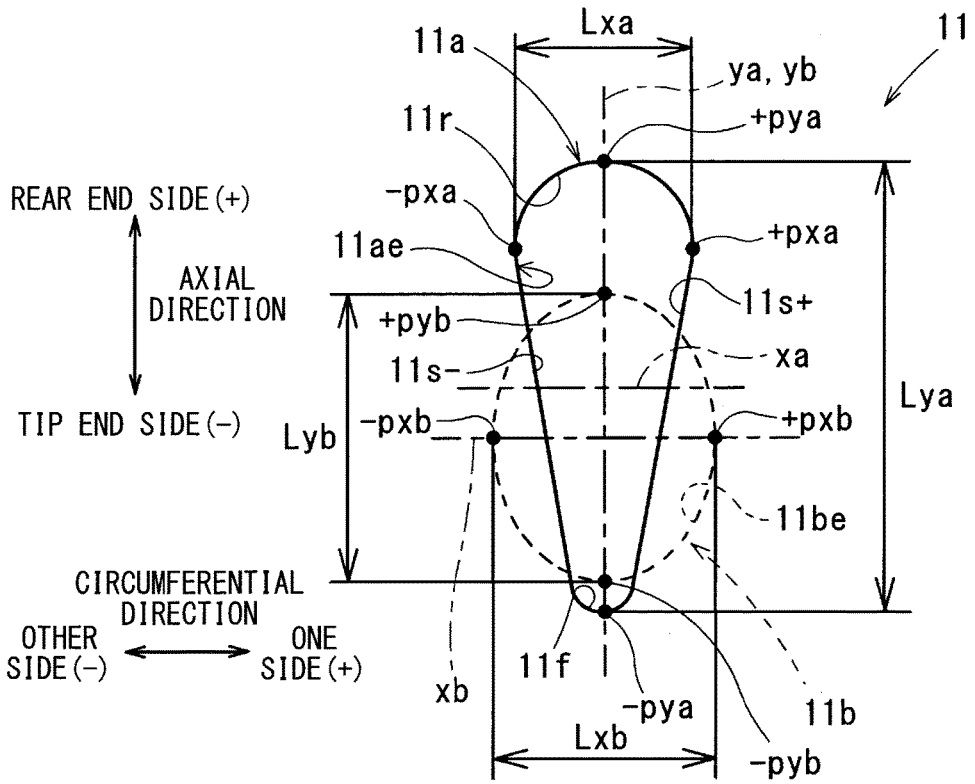
FIG. 7 is a descriptive view showing an inlet and an outlet of an injection hole according to a third embodiment of the present disclosure.

In the nozzle 1 of the third embodiment, as shown in FIG. 7, the shape of the opening edge 11*be* of the outlet 11*b* is an ellipse. The maximum value Lxb is equal to a minor diameter of the ellipse of the opening edge 11*be*, and the maximum value Lyb is equal to a major diameter of the ellipse of the opening edge 11*be*.

Furthermore, the shape of the opening edge 11*ae* of the inlet 11*a* is the same as that of the nozzle 1 of the first embodiment, and the maximum value Lxb is larger than the maximum value Lxa.

Fourth Embodiment

A characteristic structure of a nozzle 1 according to a fourth embodiment of the present disclosure will be described mainly with respect to differences, which differ from the nozzle 1 of the first embodiment.

Figure 8:
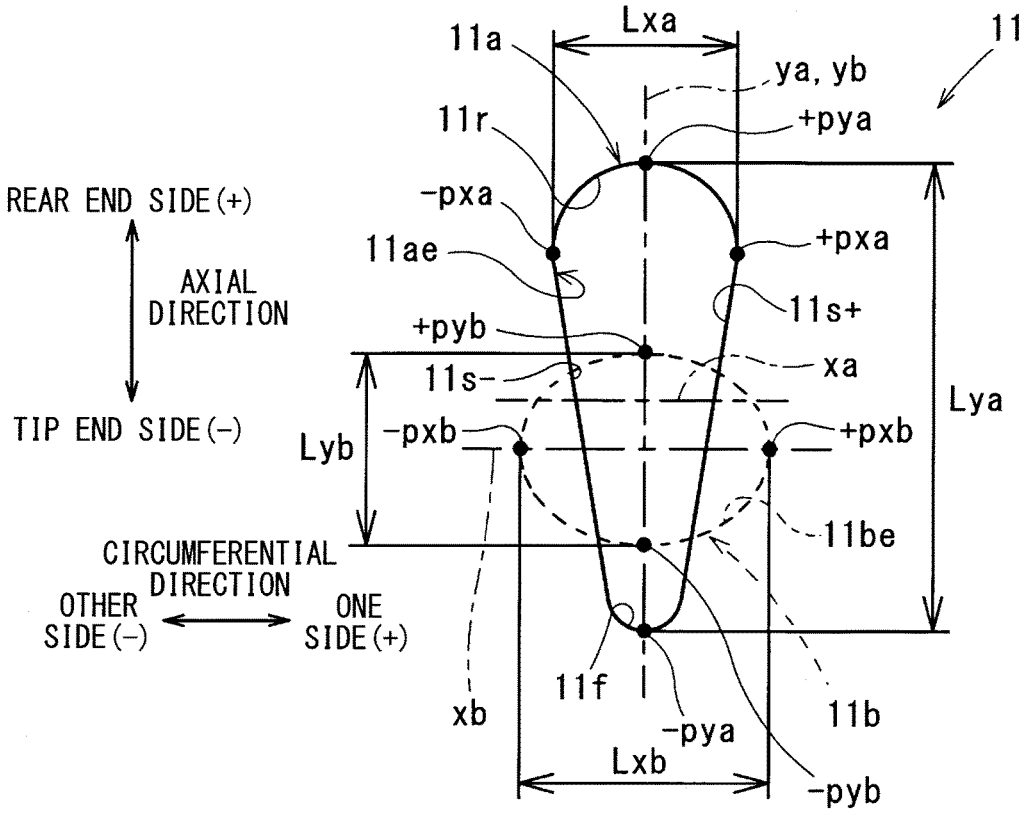
FIG. 8 is a descriptive view showing an inlet and an outlet of an injection hole according to a fourth embodiment of the present disclosure.

In the nozzle 1 of the fourth embodiment, as shown in FIG. 8, the shape of the opening edge 11*be* of the outlet 11*b* is an ellipse. The maximum value Lxb is equal to a major diameter of the ellipse of the opening edge 11*be*, and the maximum value Lyb is equal to a minor diameter of the ellipse of the opening edge 11*be*.

Furthermore, the shape of the opening edge 11*ae* of the inlet 11*a* is the same as that of the nozzle 1 of the first embodiment, and the maximum value Lxb is larger than the maximum value Lxa.

Fifth Embodiment

A characteristic structure of a nozzle 1 according to a fifth embodiment of the present disclosure will be described mainly with respect to differences, which differ from the nozzle 1 of the first embodiment.

Figure 9:
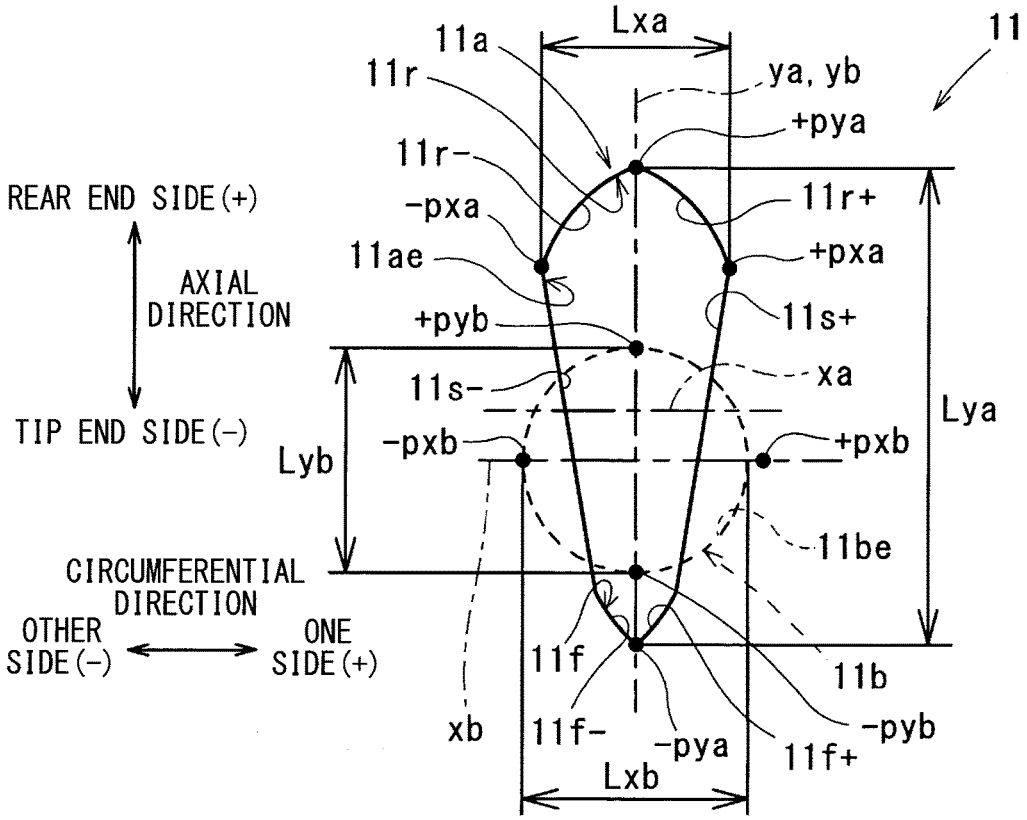
FIG. 9 is a descriptive view showing an inlet and an outlet of an injection hole according to a fifth embodiment of the present disclosure.

In the nozzle 1 of the fifth embodiment, as shown in FIG. 9, the rear end edge 11*r* includes an arc segment 11*r*+ located on the one circumferential side and an arc segment 11*r*− located on the other circumferential side, and the arc segment 11*r*+ and the arc segment 11*r*− are symmetrical about the inlet longitudinal axis ya (serving as the axis of symmetry) along the circumferential direction. The arc segment 11*r*+ is located on the one circumferential side and is recessed toward the one circumferential side, and the arc segment 11*r*− is located on the other circumferential side and is recessed toward the other circumferential side. The arc segment 11*r*+ and the arc segment 11*r*− join together on the inlet longitudinal axis ya to form the maximum longitudinal length forming point +pya between the arc segment 11*r*+ and the arc segment 11*r*−. However, the state of the connection between the arc segment 11*r*+ and the arc segment 11*r*− is not smooth.

Furthermore, similar to the arc segments 11*r*+, 11*r*− of the rear end edge 11*r*, the leading end edge 11*f* includes an arc segment 11*f*+ located on one circumferential side and an arc segment 11*f*− located on the other circumferential side, and the arc segment 11*f*+ and the arc segment 11*f*− are symmetrical about the inlet longitudinal axis ya (serving as the axis of symmetry) along the circumferential direction. The arc segment 11*f*+ and the arc segment 11*f*− join together on the inlet longitudinal axis ya to form the maximum longitudinal length forming point −pya between the arc segment 11*f*+ and the arc segment 11*f*−. However, the state of the connection between the arc segment 11*f*+ and the arc segment 11*f*− is not smooth. Furthermore, the lateral edges 11*s*+, 11*s*− connect between the tip end edge 11*f* and the rear end edge 11*r*. However, the state of the connection between the lateral edge 11*s*+ and the tip end edge 11*f*, the state of the connection between the lateral edge 11*s*+ and the rear end edge 11*r*, the state of the connection between the lateral edge 11*s*− and the tip end edge 11*f*, and the state of the connection between the lateral edge 11*s*− and the rear end edge 11*r* are also not smooth.

The lateral edge 11*s*+ and the lateral edge 11*s*− are symmetrical about the inlet longitudinal axis ya along the circumferential direction, and the entire opening edge 11*ae* is symmetrical about the inlet longitudinal axis ya along the circumferential direction. Furthermore, the shape of the opening edge 11*be* of the outlet 11*b* is the same as that of the nozzle 1 of the first embodiment, and the maximum value Lxb is larger than the maximum value Lxa.

Sixth Embodiment

A characteristic structure of a nozzle 1 according to a sixth embodiment of the present disclosure will be described mainly with respect to differences, which differ from the nozzle 1 of the first embodiment.

Figure 10:
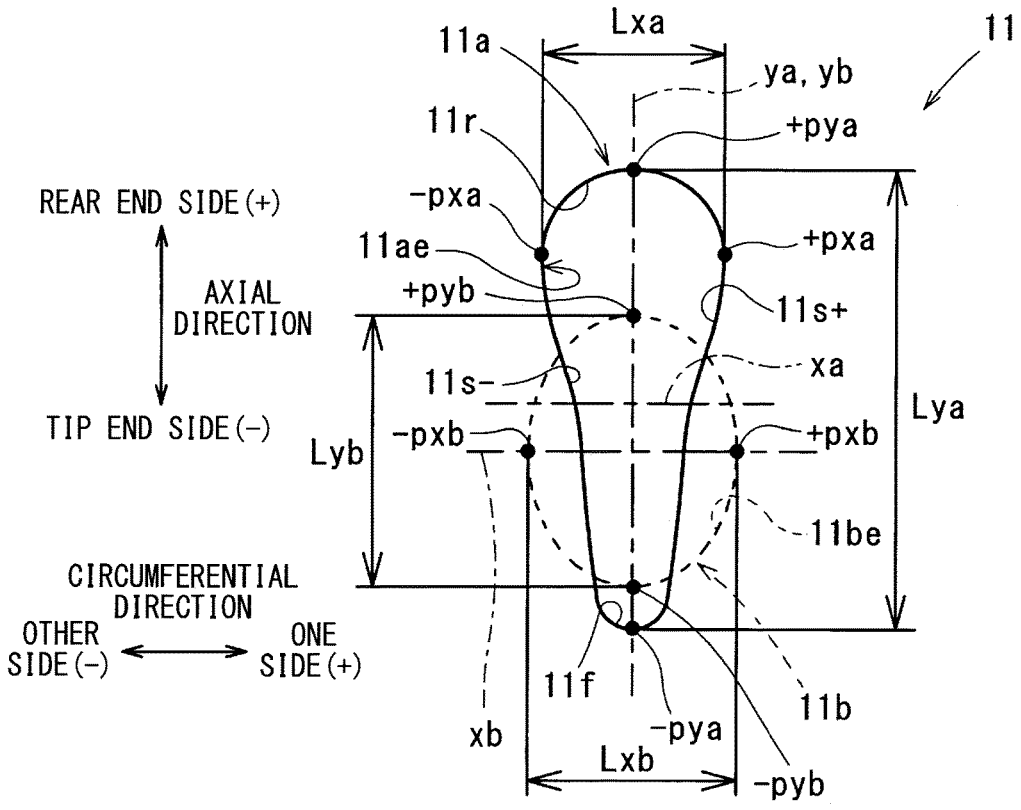
FIG. 10 is a descriptive view showing an inlet and an outlet of an injection hole according to a sixth embodiment of the present disclosure.

In the nozzle 1 of the sixth embodiment, as shown in FIG. 10, the shape of the opening edge 11*be* of the outlet 11*b* is an ellipse. The maximum value Lxb is equal to a minor diameter of the ellipse of the opening edge 11*be*, and the maximum value Lyb is equal to a major diameter of the ellipse of the opening edge 11*be*.

In the opening edge 11*ae* of the inlet 11*a*, the lateral edge 11*s*+ is formed as a curve line segment that protrudes toward the other circumferential side, while the rear end side and the tip end side of this curve line segment are slightly recessed toward the one circumferential side and are smoothly connected to the rear end edge 11*r* and the tip end edge 11*f*. In the opening edge 11*ae* of the inlet 11*a*, the lateral edge 11*s*− is formed as a curve line segment that protrudes toward the one circumferential side, while the rear end side and the tip end side of this curve line segment are slightly recessed toward the other circumferential side and are smoothly connected to the rear end edge 11*r* and the tip end edge 11*f*. The lateral edge 11*s*+ and the lateral edge 11*s*− are symmetrical about the inlet longitudinal axis ya along the circumferential direction.

The shape of the rear end edge 11*r* and the shape of the tip end edge 11*f* are the same as those of the first embodiment, and the entire opening edge 11*ae* is symmetrical about the inlet longitudinal axis ya (serving as the axis of symmetry) along the circumferential direction. Furthermore, the maximum value Lxb is larger than the maximum value Lxa.

Seventh Embodiment

A characteristic structure of a nozzle 1 according to a seventh embodiment of the present disclosure will be described mainly with respect to differences, which differ from the nozzle 1 of the first embodiment.

Figure 11:
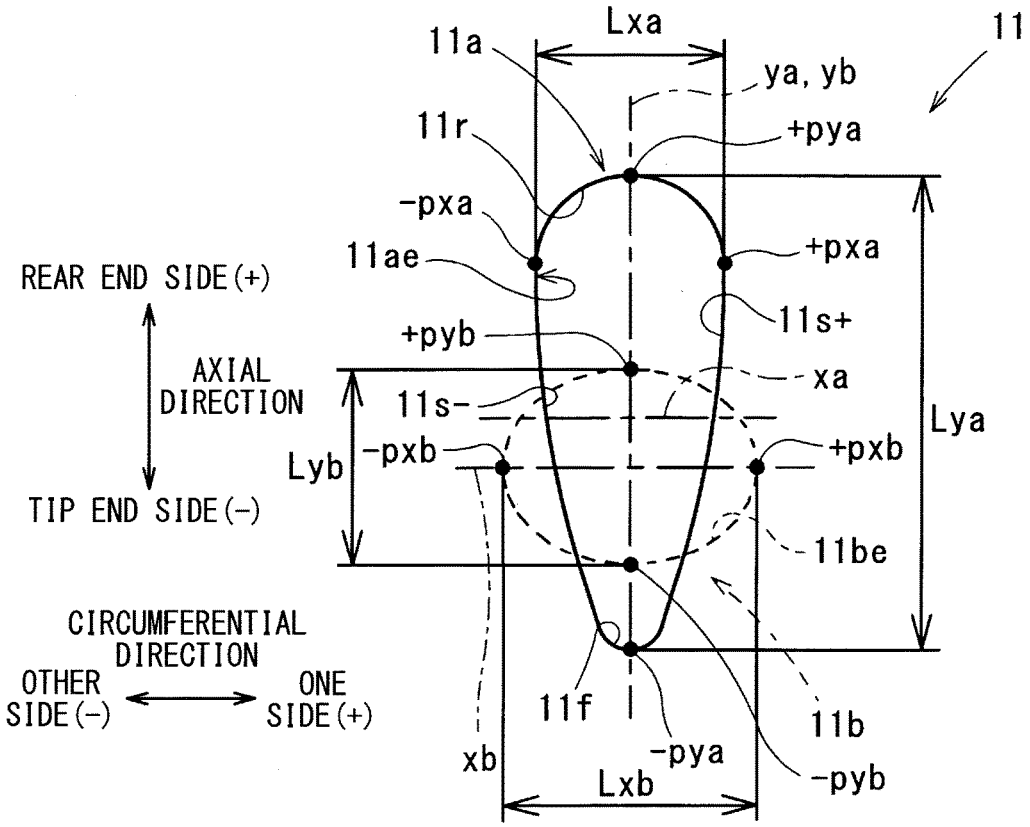
FIG. 11 is a descriptive view showing an inlet and an outlet of an injection hole according to a seventh embodiment of the present disclosure.

In the nozzle 1 of the seventh embodiment, as shown in FIG. 11, the shape of the opening edge 11*be* of the outlet 11*b* is an ellipse. The maximum value Lxb is equal to a major diameter of the ellipse of the opening edge 11*be*, and the maximum value Lyb is equal to a minor diameter of the ellipse of the opening edge 11*be*.

In the opening edge 11*ae* of the inlet 11*a*, the lateral edge 11*s*+ is formed as a curve line segment that is recessed toward the one circumferential side, while the rear end side and the tip end side of this curve line segment are smoothly connected to the rear end edge 11*r* and the tip end edge 11*f*, respectively. In the opening edge 11*ae* of the inlet 11*a*, the lateral edge 11*s*− is formed as a curve line segment that is recessed toward the other circumferential side, while the rear end side and the tip end side of this curve line segment are smoothly connected to the rear end edge 11*r* and the tip end edge 11*f*, respectively. The lateral edge 11*s*+ and the lateral edge 11*s*− are symmetrical about the inlet longitudinal axis ya along the circumferential direction.

The shape of the rear end edge 11*r* and the shape of the tip end edge 11*f* are the same as those of the first embodiment, and the entire opening edge 11*ae* is symmetrical about the inlet longitudinal axis ya (serving as the axis of symmetry) along the circumferential direction. Furthermore, the maximum value Lxb is larger than the maximum value Lxa.

Eighth Embodiment

A characteristic structure of a nozzle 1 according to an eighth embodiment of the present disclosure will be described mainly with respect to differences, which differ from the nozzle 1 of the first embodiment.

Figure 12:
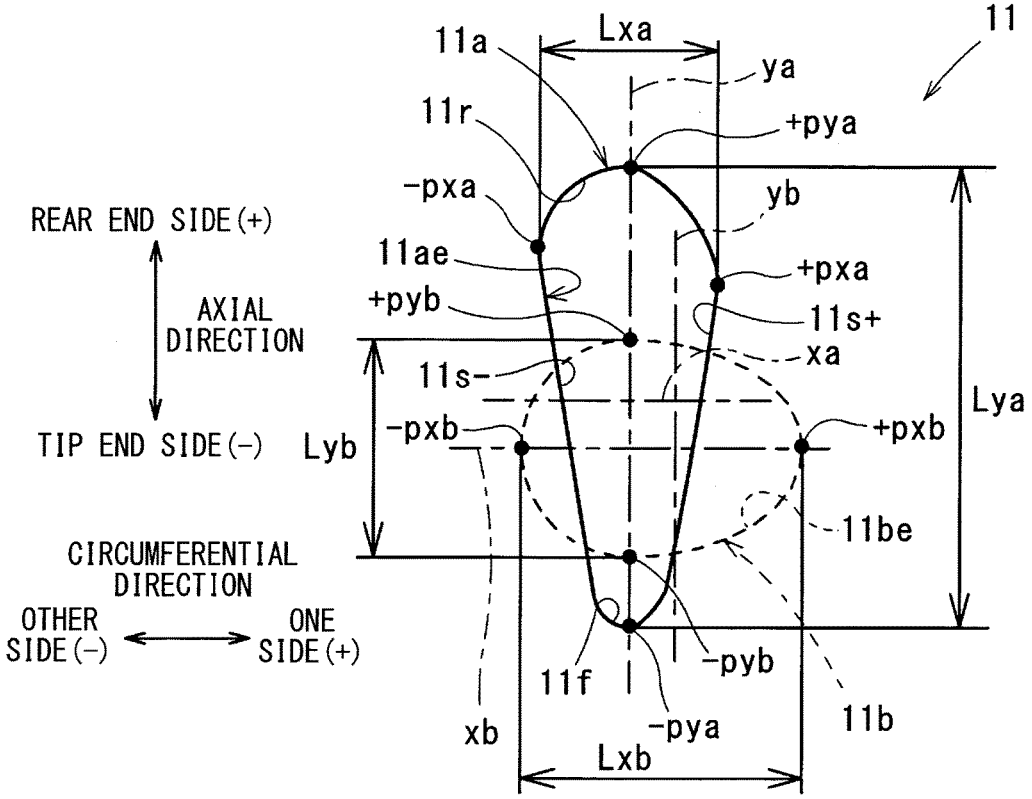
FIG. 12 is a descriptive view showing an inlet and an outlet of an injection hole according to an eighth embodiment of the present disclosure.

In the nozzle 1 of the eighth embodiment, as shown in FIG. 12, the shape of the opening edge 11*be* of the outlet 11*b* is an oval shape (egg shape), which includes a semicircular arc segment of the other circumferential side and a semi-ellipse segment of the one circumferential side, which are smoothly connected with each other along the direction of the outlet transverse axis xb. The maximum value Lxb is equal to a sum of a radius of the semicircular arc segment and ½ of a major diameter of the semi-ellipse segment, and the maximum value Lyb is equal to a diameter of the semicircular arc segment.

The opening edge 11*ae* is asymmetrical on two sides of the inlet longitudinal axis ya.

Specifically, a portion of the rear end edge 11*r*, which is located on the other circumferential side of the inlet longitudinal axis ya, is a quarter arc segment (quarter circle segment) having a central angle of 90 degrees. Furthermore, a portion of the rear end edge 11*r*, which is located on the one circumferential side of the inlet longitudinal axis ya, is an arc segment that has a curvature, which is smaller than a curvature of the quarter arc segment. In the rear end edge 11*r*, the quarter arc segment and the arc segment are smoothly connected together, and the maximum transverse length forming point +pxa is located on the tip end side of the maximum transverse length forming point −pxa.

A portion of the tip end edge 11*f*, which is located on the other circumferential side of the inlet longitudinal axis ya, is an arc segment, which has a central angle of equal to or less than 90 degrees, and a portion of the tip end edge 11*f*, which is located on the one circumferential side of the inlet longitudinal axis ya, is an arc segment that has a curvature, which is smaller than a curvature of the arc segment located on the other circumferential side of the inlet longitudinal axis ya. In the tip end edge 11*f*, the above arc segment, which is located on the other circumferential side of the inlet longitudinal axis ya, and the above arc segment, which is located on the one circumferential side of the inlet side longitudinal axis ya, are smoothly connected with each other. The lateral edges 11*s*+, 11*s*− are respectively smoothly connected to both of the tip end edge 11*f* and the rear end edge 11*r*.

Furthermore, the maximum value Lxb is larger than the maximum value Lxa.

Ninth Embodiment

A characteristic structure of a nozzle 1 according to a ninth embodiment of the present disclosure will be described mainly with respect to differences, which differ from the nozzle 1 of the first embodiment.

Figure 13:
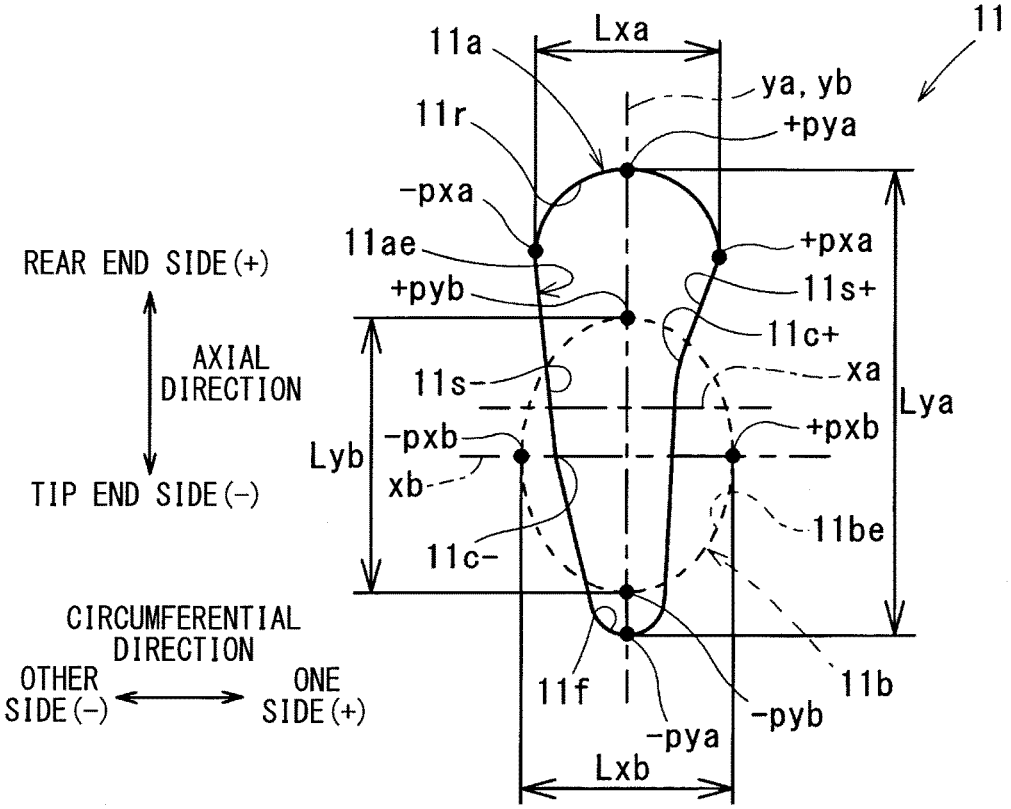
FIG. 13 is a descriptive view showing an inlet and an outlet of an injection hole according to a ninth embodiment of the present disclosure.
Figure 14:
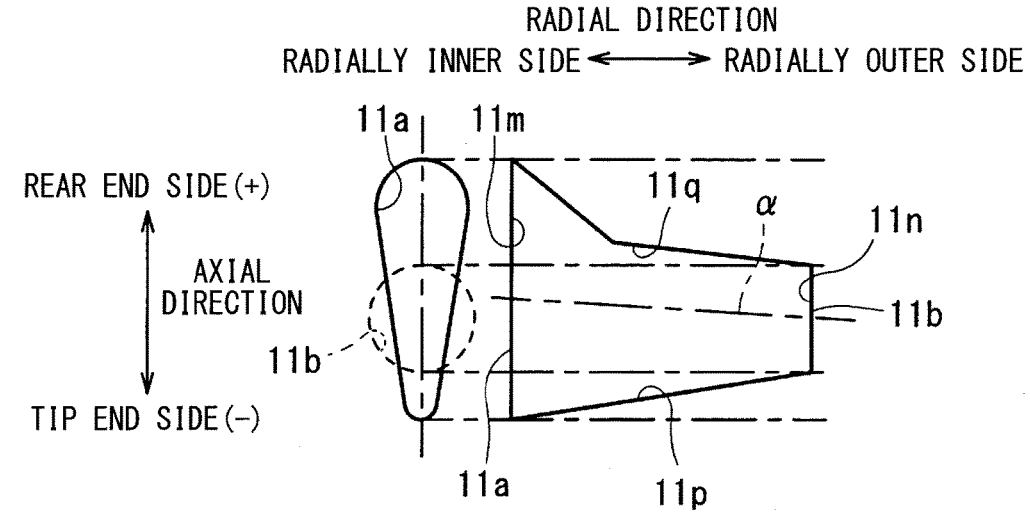
FIG. 14 is a descriptive view showing a cross section of an injection hole including an injection hole axis according to a tenth embodiment of the present disclosure.
Figure 15:
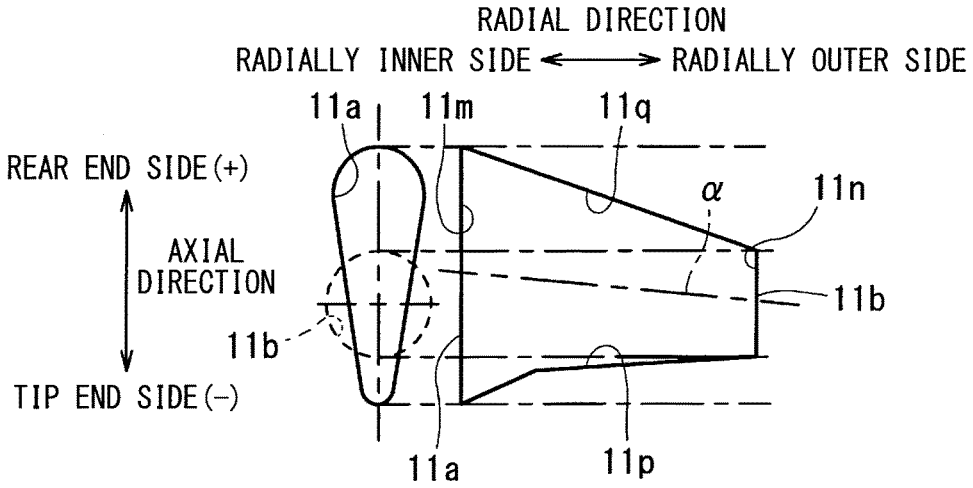
FIG. 15 is a descriptive view showing a cross section of an injection hole including an injection hole axis according to an eleventh embodiment of the present disclosure.
Figure 16:
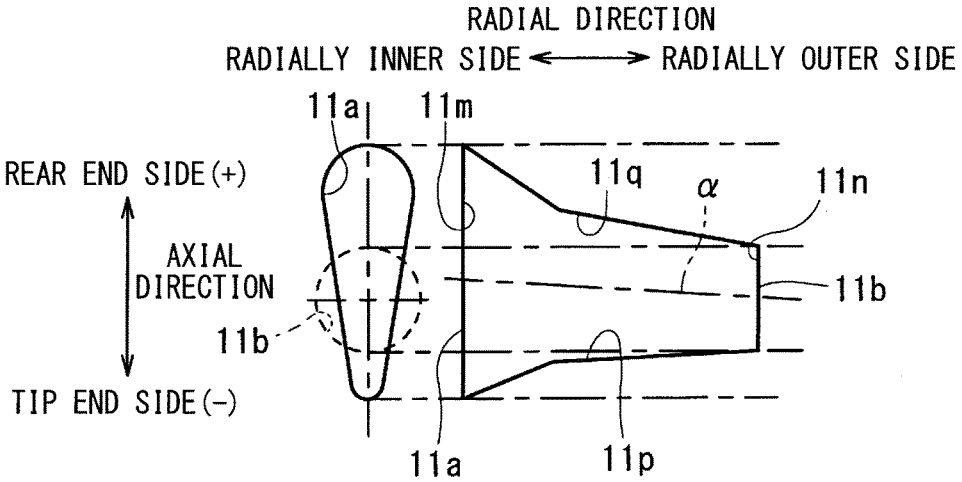
FIG. 16 is a descriptive view showing a cross section of an injection hole including an injection hole axis according to a twelfth embodiment of the present disclosure.
Figure 17:
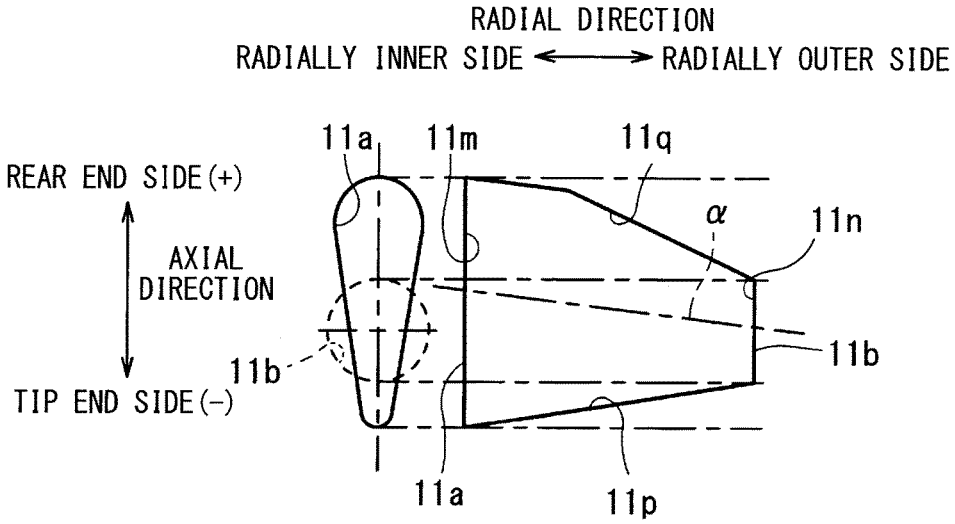
FIG. 17 is a descriptive view showing a cross section of an injection hole including an injection hole axis according to a thirteenth embodiment of the present disclosure.
Figure 18:
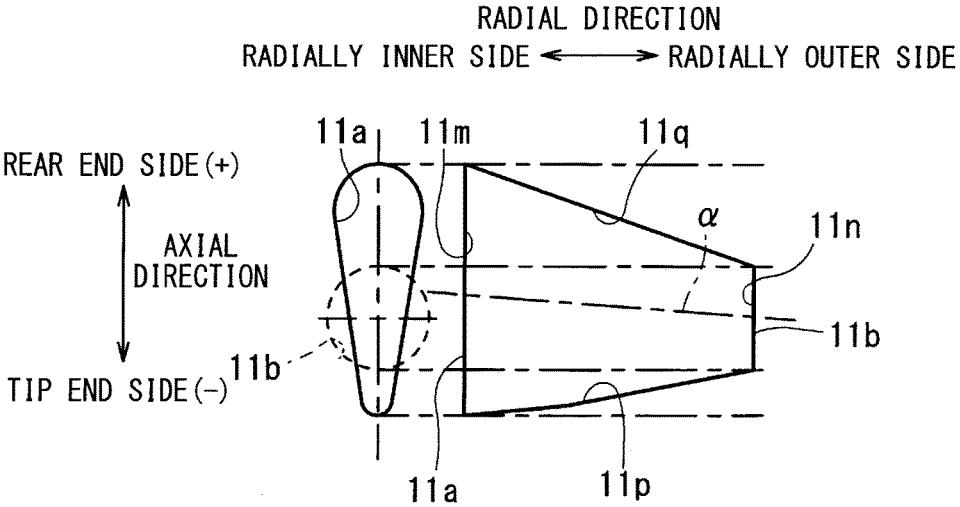
FIG. 18 is a descriptive view showing a cross section of an injection hole including an injection hole axis according to a fourteenth embodiment of the present disclosure.
Figure 19:
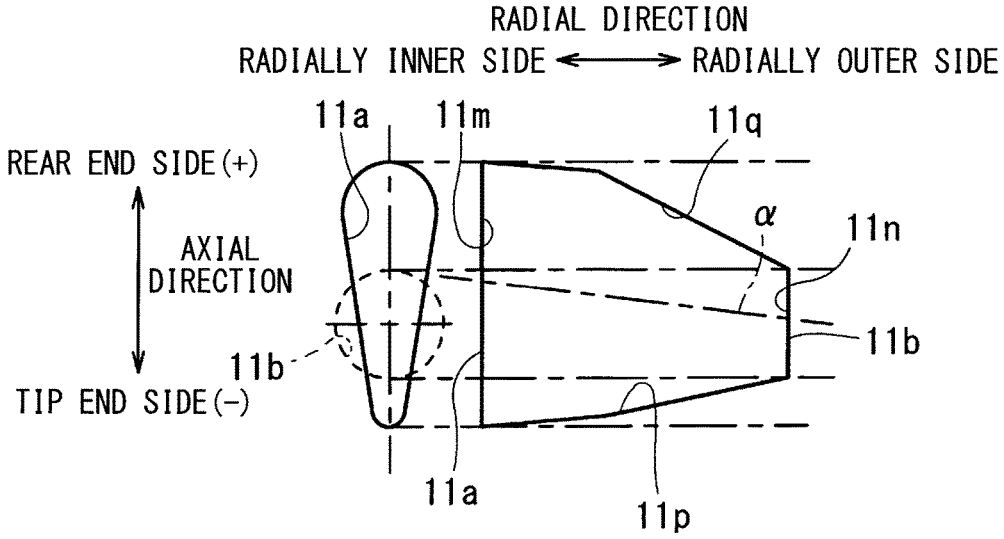
FIG. 19 is a descriptive view showing a cross section of an injection hole including an injection hole axis according to a fifteenth embodiment of the present disclosure.
Figure 20:
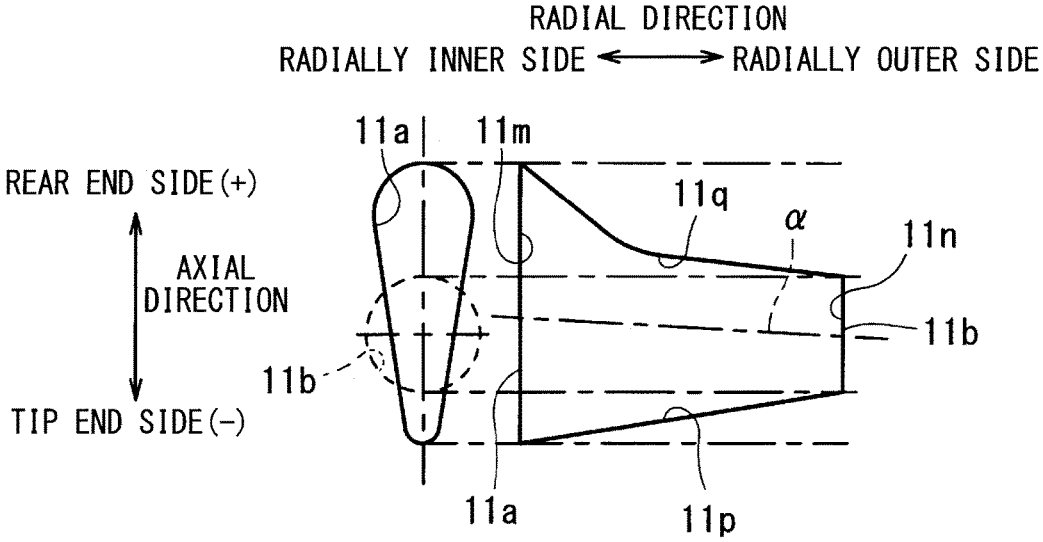
FIG. 20 is a descriptive view showing a cross section of an injection hole including an injection hole axis according to a sixteenth embodiment of the present disclosure.
Figure 21:
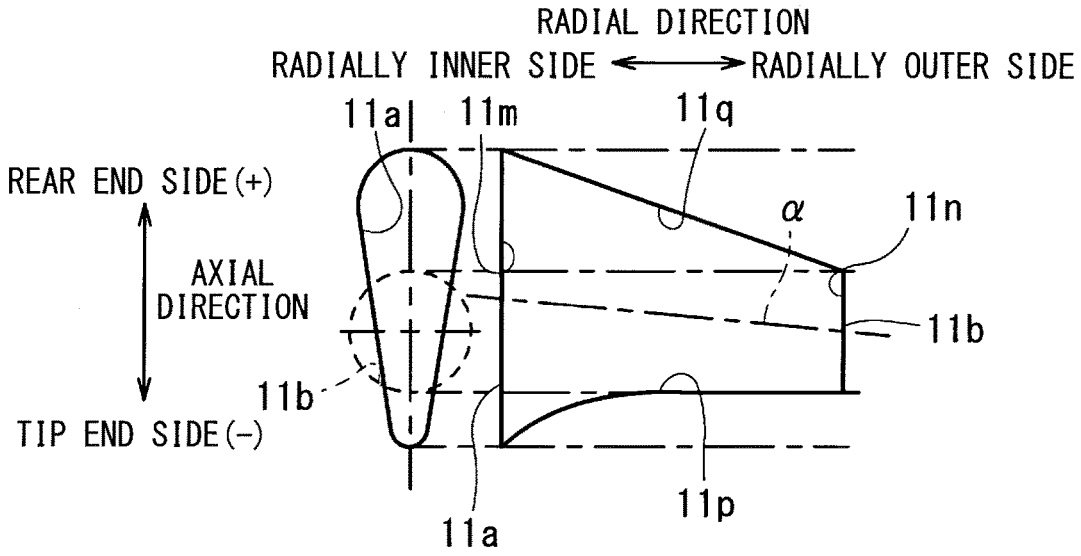
FIG. 21 is a descriptive view showing a cross section of an injection hole including an injection hole axis according to a seventeenth embodiment of the present disclosure.
Figure 22:
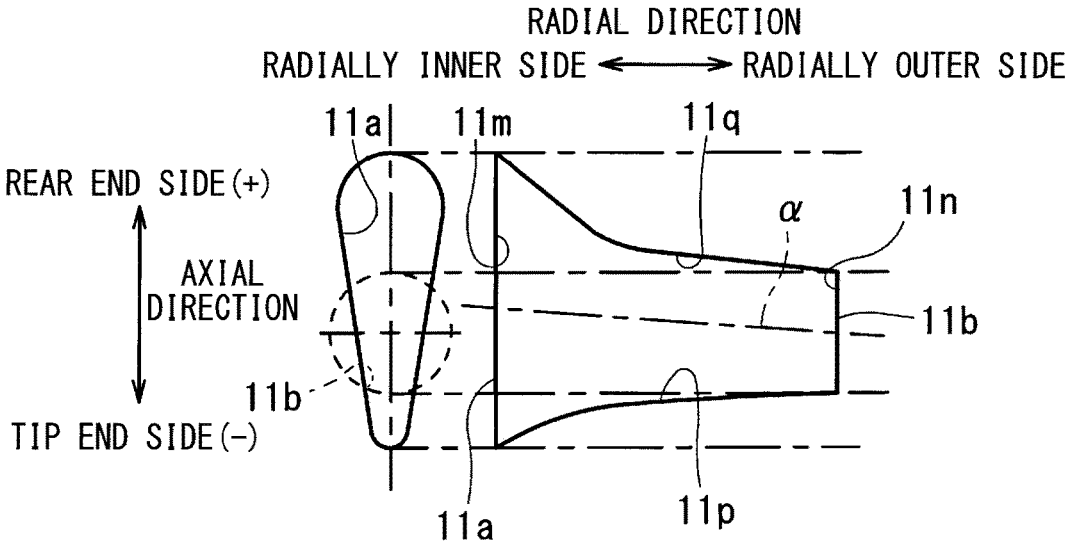
FIG. 22 is a descriptive view showing a cross section of an injection hole including an injection hole axis according to an eighteenth embodiment of the present disclosure.
Figure 23:
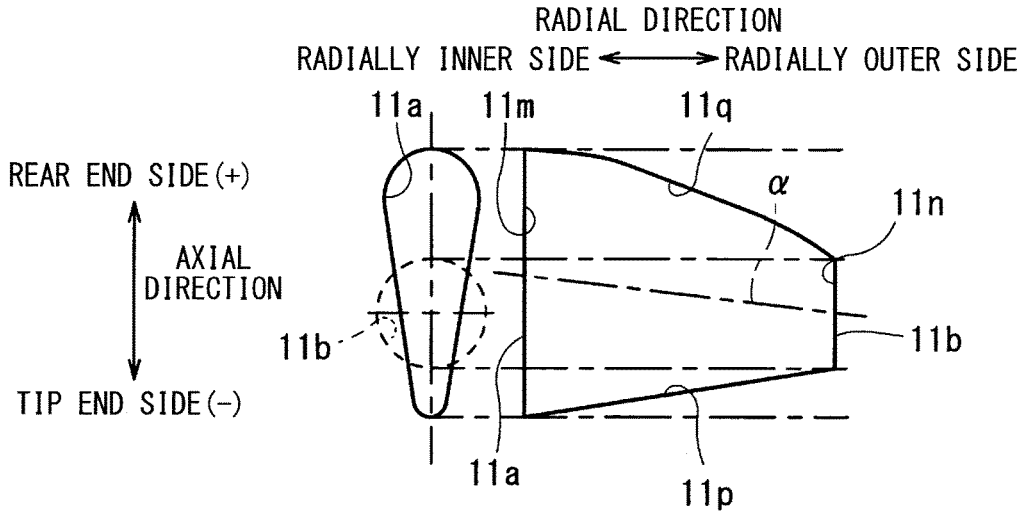
FIG. 23 is a descriptive view showing a cross section of an injection hole including an injection hole axis according to a nineteenth embodiment of the present disclosure.
Figure 24:
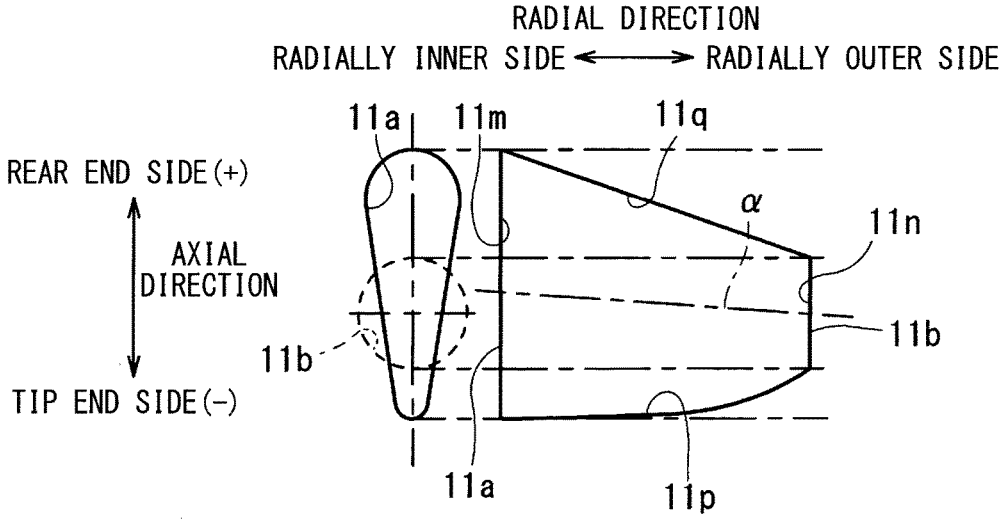
FIG. 24 is a descriptive view showing a cross section of an injection hole including an injection hole axis according to a twentieth embodiment of the present disclosure.
Figure 25:
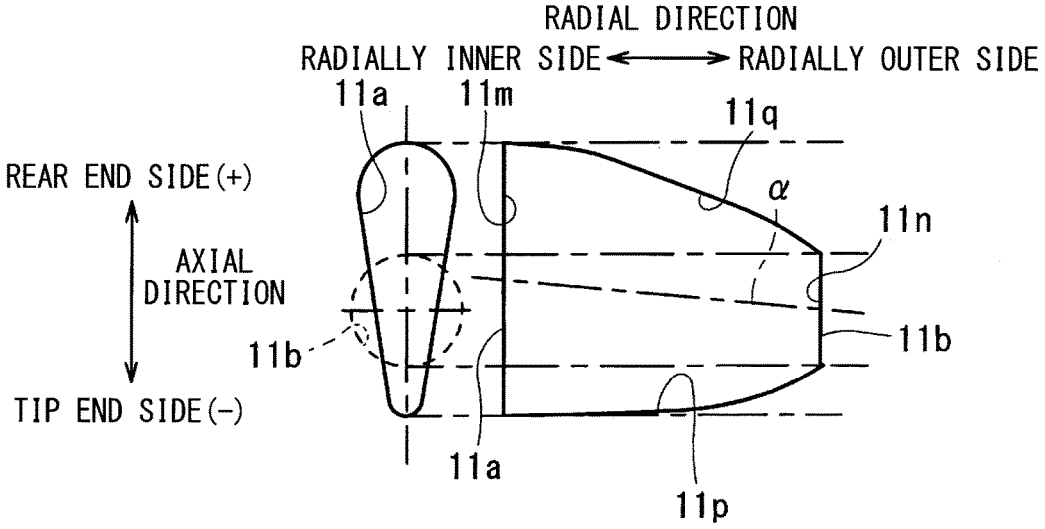
FIG. 25 is a descriptive view showing a cross section of an injection hole including an injection hole axis according to a twenty-first embodiment of the present disclosure.

In the nozzle 1 of the ninth embodiment, as shown in FIG. 13, the shape of the opening edge 11*be* of the outlet 11*b* is an ellipse. The maximum value Lxb is equal to a minor diameter of the ellipse of the opening edge 11*be*, and the maximum value Lyb is equal to a major diameter of the ellipse of the opening edge 11*be*.

The opening edge 11*ae* is asymmetrical on two sides of the inlet longitudinal axis ya.

Specifically, the lateral edge 11*s*+ and the lateral edge 11*s*− are asymmetrical about the inlet longitudinal axis ya. That is, the lateral edge 11*s*+ includes a bent segment 11*c*+, which is bent and protrudes toward the other circumferential side, and the lateral edge 11*s*− includes a bent segment 11*c*−, which is bent and is recessed toward the other circumferential side. The lateral edge 11*s*− is smoothly connected to both of the tip end edge 11*f* and the rear end edge 11*r*, and the lateral edge 11*s*+ is smoothly connected to the tip end edge 11*f*.

The state of the connection between the lateral edge 11*s*+ and the rear end edge 11*r* is not smooth. The shape of the rear end edge 11*r* and the shape of the tip end edge 11*f* are the same as those of the nozzle 1 of the first embodiment. Furthermore, the maximum value Lxb is larger than the maximum value Lxa.

Tenth to Twenty-First Embodiments

Characteristic structures of nozzles 1 according to tenth to twenty-first embodiments (10th to 21st embodiments) will be described mainly with respect to differences, which differ from the nozzle 1 of the first embodiment.

In each of the nozzles 1 of the tenth to twenty-first embodiments, as shown in FIGS. 14 to 25, the shape of the opening edge 11*ae* of the inlet 11*a* and the shape of the opening edge 11*be* of the outlet 11*b* are the same as those of the nozzle 1 of the first embodiment, and a shape of a cross section of the injection hole 11, which includes the hole axis α (i.e., which is taken along the hole axis α) is different from that of the nozzle 1 of the first embodiment. In the cross section taken along the hole axis α, the sides 11*m*, 11*n*, which are respectively included in the inlet 11*a* and the outlet 11*b*, are parallel to each other in the nozzles 1 of all of the tenth to twenty-first embodiments.

In the nozzle 1 of the tenth embodiment, a side (edge) 11*q* of the cross section, which is located at the rear end side, is bent and protrudes toward the tip end side to form a bend, and the state of the bend of the side 11*q* is not smooth. A shape of a side (edge) 11*p* of the cross section, which is located at the tip end side, is the same as that of the nozzle 1 of the first embodiment (see FIG. 14). In the nozzle 1 of the eleventh embodiment, the side 11*p* of the cross section, which is located at the tip end side, is bent and protrudes toward the rear end side to form a bend, and the state of the bend of the side 11*q* is not smooth. In the eleventh embodiment, a shape of the side 11*q* of the cross section, which is located at the rear end side, is the same as that of the nozzle 1 of the first embodiment (see FIG. 15). In the nozzle 1 of the twelfth embodiment, the side 11*q* of the cross section, which is located at the rear end side, is bent and protrudes toward the tip end side to form a bend, while the state of the bend of the side 11*q* is not smooth, and the side 11*p* of the cross section, which is located at the tip end side, is bent and protrudes toward the rear end side to form a bend, while the state of the bend of the side 11*q* is not smooth (see FIG. 16).

In the nozzle 1 of the thirteenth embodiment, the side 11*q* of the cross section, which is located at the rear end side, is bent and is recessed toward the rear end side to form a bend, and the state of the bend of the side 11*q* is not smooth. A shape of the side 11*p* of the cross section, which is located at the tip end side, is the same as that of the nozzle 1 of the first embodiment (see FIG. 17). In the nozzle 1 of the fourteenth embodiment, the side 11*p* of the cross section, which is located at the tip end side, is bent and is recessed toward the tip end side to form a bend, and the state of the bend of the side 11*p* is not smooth. In the fourteenth embodiment, a shape of the side 11*q* of the cross section, which is located at the rear end side, is the same as that of the nozzle 1 of the first embodiment (see FIG. 18). In the nozzle 1 of the fifteenth embodiment, the side 11*q* of the cross section, which is located at the rear end side, is bent and is recessed toward the rear end side to form a bend, while the state of the bend of the side 11*q* is not smooth, and the side 11*p* of the cross section, which is located at the tip end side, is bent and is recessed toward the tip end side to form a bend, while the state of the bend of the side 11*p* is not smooth (see FIG. 19).

In the nozzle 1 of the sixteenth embodiment, the side 11*q* of the cross section, which is located at the rear end side, is bent and protrudes toward the tip end side to form a bend, and the state of the bend of the side 11*q* is smooth. In the sixteenth embodiment, a shape of the side 11*p* of the cross section, which is located at the tip end side, is the same as that of the nozzle 1 of the first embodiment (see FIG. 20). In the nozzle 1 of the seventeenth embodiment, the side 11*p* of the cross section, which is located at the tip end side, is bent and protrudes toward the rear end side to form a bend, and the state of the bend of the side 11*p* is smooth. In the seventeenth embodiment, a shape of the side 11*q* of the cross section, which is located at the rear end side, is the same as that of the nozzle 1 of the first embodiment (see FIG. 21). In the nozzle 1 of the eighteenth embodiment, the side 11*q* of the cross section, which is located at the rear end side, is bent and protrudes toward the tip end side to form a bend, while the state of the bend of the side 11*q* is smooth, and the side 11*p* of the cross section, which is located at the tip end side, is bent and protrudes toward the rear end side to form a bend, while the state of the bend of the side 11*p* is smooth (see FIG. 22).

In the nozzle 1 of the nineteenth embodiment, the side 11*q* of the cross section, which is located at the rear end side, is bent and is recessed toward the rear end side to form a bend, and the state of the bend of the side 11*q* is smooth. A shape of the side 11*p* of the cross section, which is located at the tip end side, is the same as that of the nozzle 1 of the first embodiment (see FIG. 23). In the nozzle 1 of the twentieth embodiment, the side 11*p* of the cross section, which is located at the tip end side, is bent and is recessed toward the tip end side to form a bend, and the state of the bend of the side 11*p* is smooth. In the twentieth embodiment, a shape of the side 11*q* of the cross section, which is located at the rear end side, is the same as that of the nozzle 1 of the first embodiment (see FIG. 24). In the nozzle 1 of the twenty-first embodiment, the side 11*q* of the cross section, which is located at the rear end side, is bent and is recessed toward the rear end side to form a bend, while the state of the bend of the side 11*q* is smooth, and the side 11*p* of the cross section, which is located at the tip end side, is bent and is recessed toward the tip end side to form a bend, while the state of the bend of the side 11*p* is smooth (see FIG. 25).

Now, modifications of the above embodiments will be described.

The nozzle 1 of the present disclosure is not limited to the above embodiments, and the present disclosure includes further possible modifications of the above embodiment. For example, in the above embodiments, the sides 11*m*, 11*n* are included in the inlet 11*a* and the outlet 11*b*, respectively, in the cross section of the injection hole 11 taken along the hole axis α, and the sides 11*m*, 11*n* are parallel to each other. However, the sides 11*m*, 11*n* may be not parallel to each other depending on a need.

Furthermore, in the above embodiments, the maximum transverse length forming points +pxa, −pxa are located on the rear end side of the inlet transverse axis xa in the opening edge 11*ae* of the injection hole 11. Alternatively, the maximum transverse length forming points +pxa, −pxa may be placed on the tip end side of the inlet transverse axis xa in the opening edge 11*ae* of the injection hole 11.

What is claimed is:

1. A fuel injection nozzle comprising:

a nozzle body that is shaped into a tubular form; and a needle that is received in an inside of the nozzle body in such a manner that the needle is movable in an axial direction of the nozzle body, wherein the fuel injection nozzle starts or stops injection of fuel by lifting or seating the needle relative to a seat portion, which is formed in an inner peripheral portion of the nozzle body, wherein:

the nozzle body includes an injection hole that opens in both of an inner wall and an outer wall of the nozzle body on a tip end side of the seat portion in the axial direction, wherein the tip end side is a side where a tip end of the nozzle body is placed, while a rear end side is a side where a rear end of the nozzle body is placed;

in a state where the needle is seated against the seat portion, when the needle is moved from the seat portion toward the rear end side in the axial direction, the needle is lifted from the seat portion, and thereby the fuel is guided from the inside of the nozzle body to an outside of the nozzle body through the injection hole;

with respect to an inlet, which is an opening of the injection hole in the inner wall, an inlet transverse axis is defined to extend in a circumferential direction of the nozzle body in parallel with a plane of the inlet, and an inlet longitudinal axis is defined to extend in a direction perpendicular to the inlet transverse axis in parallel with the plane of the inlet;

with respect to an outlet, which is an opening of the injection hole in the outer wall, an outlet transverse axis is defined to extend in the circumferential direction in parallel with a plane of the outlet, and an outlet longitudinal axis is defined to extend in a direction perpendicular to the outlet transverse axis in parallel with the plane of the outlet;

a maximum value of a longitudinal length of the inlet measured in a direction of the inlet longitudinal axis is larger than a maximum value of a longitudinal length of the outlet measured in a direction of the outlet longitudinal axis;

a maximum value of a transverse length of the inlet measured in the direction of the inlet transverse axis is defined between two maximum transverse length forming points of an opening edge of the inlet, and a rear end portion of the opening edge of the inlet, which is located on the rear end side of the two maximum transverse length forming points, is shaped into an arc;

a remaining portion of the opening edge of the inlet, which is other than the rear end portion and is located on the tip end side of the two maximum transverse length forming points, includes two straight lateral edges, which extend linearly and are respectively placed at one circumferential side and another circumferential side of the opening edge of the inlet; and the two straight lateral edges are tapered toward the tip end side, and thereby the transverse length, which is measured between the two straight lateral edges in the direction of the inlet transverse axis, is progressively decreased from the two maximum transverse length forming points toward a tip end of the opening edge of the inlet.

2. The fuel injection nozzle according to claim 1, wherein in the opening edge of the inlet, the two maximum transverse length forming points are located on the rear end side of a point, at which ½ of the maximum value of the longitudinal length of the inlet is measured along the inlet longitudinal axis.

3. The fuel injection nozzle according to claim 1, wherein a maximum value of a transverse length of the outlet measured in a direction of the outlet transverse axis is larger than the maximum value of the transverse length of the inlet measured in the direction of the inlet transverse axis.

4. The fuel injection nozzle according to claim 1, wherein the rear end portion is an arcuate rear end edge that connects between the two maximum transverse length forming points and is arcuate along an entire extent of the arcuate rear end edge between the two maximum transverse length forming points.

5. The fuel injection nozzle according to claim 1, wherein the injection hole is one of a plurality of injection holes, which are arranged one after another in the circumferential direction at the nozzle body.

* * * * *